US009212658B2

(12) United States Patent
Gebert

(10) Patent No.: US 9,212,658 B2
(45) Date of Patent: Dec. 15, 2015

(54) PUMP FACILITY FOR A HEARING DEVICE AND METHOD OF INFLATING AND DEFLATING AN EARMOLD MEMBER

(71) Applicant: SIVANTOSE PTE. LTD., Singapore (SG)

(72) Inventor: Anton Gebert, Kleinsendelbach (DE)

(73) Assignee: Sivantos Pte. Ltd., Singapore (SG)

( * ) Notice: Subject to any disclaimer, the term of this patent is extended or adjusted under 35 U.S.C. 154(b) by 25 days.

(21) Appl. No.: 13/936,742

(22) Filed: Jul. 8, 2013

(65) Prior Publication Data

US 2014/0010674 A1 Jan. 9, 2014

Related U.S. Application Data

(60) Provisional application No. 61/668,521, filed on Jul. 6, 2012, provisional application No. 61/669,694, filed on Jul. 10, 2012.

(30) Foreign Application Priority Data

Sep. 28, 2012 (DE) ..... 10 2012 217 844

(51) Int. Cl.

| | |
|---|---|
| ***H04R 25/00*** | (2006.01) |
| ***F04B 49/22*** | (2006.01) |
| ***F04B 43/04*** | (2006.01) |

(52) U.S. Cl.

CPC ..... *F04B 49/22* (2013.01); *F04B 43/043* (2013.01); *H04R 25/656* (2013.01); *H04R 2225/021* (2013.01); *H04R 2225/61* (2013.01)

(58) Field of Classification Search

CPC .. H04R 25/652; H04R 25/656; H04R 1/1016; H04R 1/1091; A61F 11/10; F04B 45/04; F04B 45/41; F04B 45/43; F04B 45/45; F04B 45/47

USPC ..... 381/312–331, 380

See application file for complete search history.

(56) References Cited

U.S. PATENT DOCUMENTS

| | | | | |
|---|---|---|---|---|
| 2010/0002897 | A1 | 1/2010 | Keady | |
| 2010/0111340 | A1 | 5/2010 | Miller et al. | |
| 2010/0322454 | A1* | 12/2010 | Ambrose et al. | 381/380 |
| 2013/0114839 | A1 | 5/2013 | Gebert | |
| 2013/0136285 | A1 | 5/2013 | Naumann | |

FOREIGN PATENT DOCUMENTS

| | | | |
|---|---|---|---|
| WO | 2012007067 | A1 | 1/2012 |
| WO | 2012007193 | A1 | 1/2012 |

* cited by examiner

*Primary Examiner* — Matthew Eason

(74) *Attorney, Agent, or Firm* — Laurence Greenberg; Werner Stemer; Ralph Locher

(57) ABSTRACT

A pump facility for an earmold of a hearing device communicates by way of a channel facility with a variable-volume element of the earmold. A medium can flow through the channel facility to the variable-volume element and away from the variable-volume element. A filling mechanism is embodied for pumping the medium through the channel facility to the variable-volume element. In addition a drainage mechanism is embodied for actively pumping and conveys the medium away from the variable-volume element through the channel facility.

9 Claims, 9 Drawing Sheets

PUMP FACILITY FOR A HEARING DEVICE AND METHOD OF INFLATING AND DEFLATING AN EARMOLD MEMBER

CROSS-REFERENCE TO RELATED APPLICATION

This application claims the benefit, under 35 U.S.C. §119 (e), of provisional patent application Nos. 61/668,521, filed Jul. 6, 2012 and 61/669,694, filed Jul. 10, 2012, and under 35 U.S.C. §119(a), of German patent application DE 10 2012 217 844.9, filed Sep. 28, 2012; the prior applications are herewith incorporated by reference in their entirety.

BACKGROUND OF THE INVENTION

Field of the Invention

The invention relates to a pump facility for an earpiece apparatus of a hearing device. More particularly, the invention pertains to a pump facility for an earmold of a hearing device, which is able to be bought into contact by way of a conduit with a variable-volume element of the earmold, so that a medium can flow from the pump facility through the conduit to the variable-volume element, with a filling mechanism embodied for pumping, which conveys the medium to the variable-volume element through the conduit.

The term hearing device, or hearing device unit, is understood here to be any device outputting sound able to be worn in the ear or on the head, such as a hearing aid, headset, headphones and the like.

Hearing devices are wearable hearing apparatuses which are used to provide hearing assistance to the hard-of-hearing. In order to accommodate the numerous individual requirements, various designs of hearing devices are available such as be-hind-the-ear (BTE) hearing devices, hearing devices with an external earpiece (RIC: receiver in the canal) and in-the-ear (ITE) hearing devices, for example also concha hearing devices or completely-in-the-canal (ITE, CIC) hearing devices. These hearing devices listed as examples are worn on the outer ear or in the auditory canal. Bone conduction hearing aids, implantable or vibrotactile hearing aids are also available on the market. With these devices the damaged hearing is stimulated either mechanically or electrically.

In many of the hearing devices mentioned by way of example the acoustic signal is conveyed by means of a sound tube from a loudspeaker or earpiece to an earmold. In this context a known method is to attach what is referred to as a dome for example or a variable-volume element, e.g. an inflatable in-ear balloon, to the earmold. This leads to a better grip of the earmold in an auditory canal.

When a variable-volume element is used on the earmold an additional channel must be routed from a pump to a variable-volume element, i.e. the in-ear balloon of the earmold for example, in order to pump said element up with air or with another medium.

The pump for this purpose can be arranged in the hearing de-vice unit or at an ear-side end of the sound tube. Placement of the pump in the earmold itself is also possible. A loudspeaker used conventionally in hearing devices, referred to as a receiver, can be used as the pump for example.

A problem with such embodiments is removing the air pumped into the variable-volume element or the respective medium from the element again.

SUMMARY OF THE INVENTION

It is accordingly an object of the invention to provide a pumping facility which overcomes the disadvantages of the heretofore-known devices and methods of this general type and which has an improved discharge of air or of another medium from a variable-volume element.

With the foregoing and other objects in view there is provided, in accordance with the invention, a pump facility for an earmold of a hearing device, which comprises:

a channel facility fluidically connectable with a variable-volume element of the earmold, enabling a medium to flow through said channel facility to and from the variable-volume element when the variable-volume element is fluidically connected to said channel facility;

a filling mechanism configured for pumping and conveying the medium to the variable-volume element through said channel facility; and a drainage mechanism embodied for pumping and conveying the medium away from the variable-volume element through said channel facility.

In other words, the objects of the invention are achieved by a novel pump facility for an earmold of a hearing device. The pump facility is able to communicate by way of a channel facility, i.e., a conduit, with a variable-volume element of the earmold such that a medium can flow from the pump facility through the conduit to the variable-volume element. A filling mechanism embodied for pumping conveys the medium through the channel facility to the variable-volume element. In addition a drainage mechanism embodied for pumping is provided, which actively pumps away the medium from the variable-volume element through the channel facility.

In a preferred embodiment, the filling medium is air. However other fluids or gases can also be used.

The filling mechanism is either a first of two pumps or a pumping-in movement of the membrane of a single pump.

Conversely the drainage mechanism is either the second of two pumps or the pumping-out movement of the membrane of an individual pump. In this way a faster and thus better emptying of the variable-volume element is achieved. Removing the air from the variable-volume element is advantageous for comfortable removal of the earmold from the auditory canal.

Preferably a first valve assembly controls an inflow of the medium from the filling mechanism to the variable-volume element. Also preferably a second valve assembly controls an outflow of the medium from the variable-volume element to an outlet. In other words the first valve assembly enables an inflow from the filling mechanism to the variable-volume element. Correspondingly the second valve assembly enables the outflow from the variable-volume element to the outlet. The use of valves or valve assemblies means that better control of the inflation and deflation of the variable-volume element is achieved.

A valve assembly can be an individual valve or a grouping of a number of valves.

In one embodiment the first valve assembly and the second valve assembly are each separate, i.e. able to be controlled individually. This means they can release the flows independently of one another in each case. In this way the degree of freedom and thus the flexibility is increased.

In a further embodiment the filling mechanism and/or the drainage mechanism have a pump membrane in each case, which are in contact with one of the valve assemblies by means of a connection element or a control element. The pump membranes move, as is usual with pumps, in a spatial direction to and fro or they oscillate up and down in the pump. This pump membrane can be combined by means of a connecting element, e.g. a rod, with one or more valves of a valve assembly. In this way, by a pumping movement, i.e. the up-and-down movement of the pump membrane, a valve can be controlled at the same time. These connecting elements can for example be made of rigid or elastic material. With a rigid material the valve moves at the same time as the pumping movement, with elastic movement it is somewhat delayed.

In a further embodiment a valve is integrated in the pump membrane. Preferably this involves a passive valve. This enables the pump membrane in the filling mechanism or in the drainage mechanism to fulfill a second function as a valve in addition to its pumping function. This leads to a saving in space in the design.

In a further embodiment other valves or valve assemblies are also designed as passive units. They are then controlled or released on reaching a specific minimum pressure which is present at the respective valve. If this minimum pressure is exceeded or not reached, the valve involved opens. In other words a valve is mechanically designed such that it opens either as from a specific underpressure or a specific overpressure.

As a development in this case at least one of the valve assemblies is preferably able to be controlled by means of the filling mechanism and/or the drainage mechanism. The suction or pressure effect of the pump membrane opens the membrane valves with a pump process.

In a further embodiment at least one of the valve assemblies is able to be actively controlled. An additional mechanism, such as an electric motor for example, opens and closes the valve. In accordance with a further development at least one of the valve assemblies is able to be controlled magnetically. This can be done by means of a magnet. Preferably this magnet is controlled by an electrical polarization. The-se variations enable the change in volume of the variable-volume element to be controlled more directly.

In addition, in a development, at least one of the valve assemblies is able to be controlled manually. This enables a manual unlocking of one of the valves to be implemented, in order for example to allow the user to initiate a direct removal of air from the variable-volume element.

In a development at least one of the valve assemblies is controlled by means of a trapeze drive. Trapeze drives are also known as pantograph drives. This type of valve control allows space to be saved in the design.

In addition the object is achieved by a method which varies the volume content of a variable-volume element on an earmold of a hearing device. In this case the variable-volume element is pumped up by means of a filling mechanism of a pump facility. The filling mechanism pumps a medium through a channel facility into the variable-volume element. The medium is pumped out of the variable-volume element by means of a drainage mechanism of the pump facility. The drainage mechanism pumps the medium out of the variable-volume element through the channel facility. Preferably, when pumped out, the medium is pumped through to an outlet where it escapes from the earmold.

Other features which are considered as characteristic for the invention are set forth in the appended claims.

Although the invention is illustrated and described herein as embodied in pump facility for a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The following description includes a variety of different embodiments. It will be understood that these exemplary embodiments should not limit the scope of the invention. Further different embodiments are possible. In addition the term air is used below as a synonym for all fluids or gases.

Figure 1:
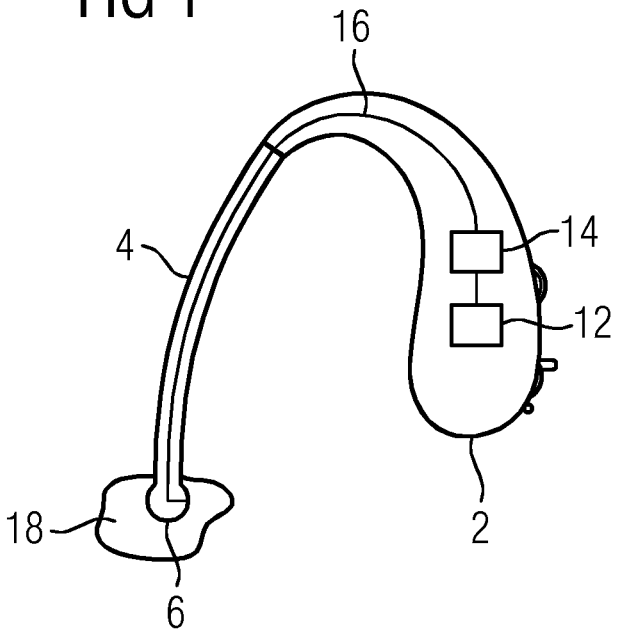
FIG. 1 shows a diagram of a hearing device with an earmold.

Referring now to the figures of the drawing in detail and first, particularly, to FIG. 1 thereof, there is shown a hearing device 2, or hearing aid 2. The hearing device 2, here in the form of a BTE (behind-the-ear) device, is connected by a sound tube 4 to an earmold 6. A pump facility 12 is arranged in the hearing device 2. This generates pressure which is conveyed by a valve assembly 14 and a conduit or channel facility 16 to a variable-volume element 18. The variable-volume element 18 is similar to a balloon, and may be referred to as a balloon; it can be inflated by means of pressure and conversely can be deflated again. Preferably to do this air is pumped as a medium into or out of the variable-volume element 18. The pressure can accordingly involve an overpressure or an underpressure.

The device is used in the intended manner by a user first introducing the earpiece facility 6 with the non-inflated variable-volume element 18 into one of his or her auditory canals. The hearing device 2 detects automatically for ex-ample that the earmold 6 has been introduced into an auditory canal and pumps air into the variable-volume element 18. As an alternative this pumping process can be initiated manually, for example by remote control or by a trigger on the hearing device 2. A button or a switch can serve as the trigger for example.

In order to remove the earmold 6 comfortably from the auditory canal the variable-volume element 18 must be emptied. For this to be done the previously pumped-in air is pumped out of the element. All the said pumping processes are preferably controlled by way of the pump facility 12 and the valve assembly 14.

In further, non-illustrated embodiments it is possible to arrange the pump facility 12 and/or the valve assembly 14 not in the hearing device 2 but in the sound tube 4 or on the earmold 6 apparatus. The conduit 16 does not absolutely have to run in the sound tube 4, it can also be arranged outside the latter.

Figure 2:
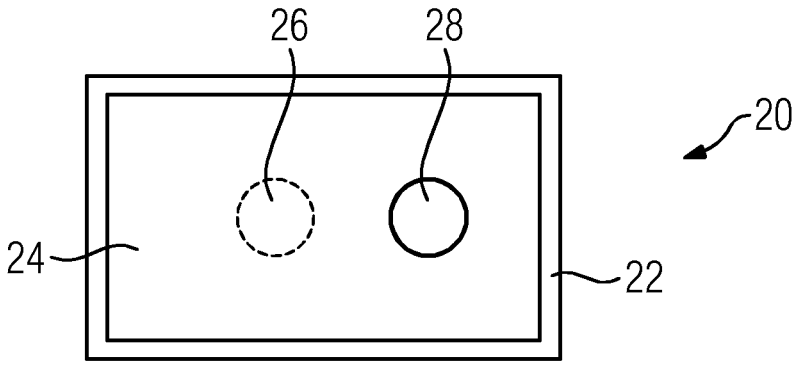
FIG. 2 is a plan view diagram of a valve.
Figure 3:
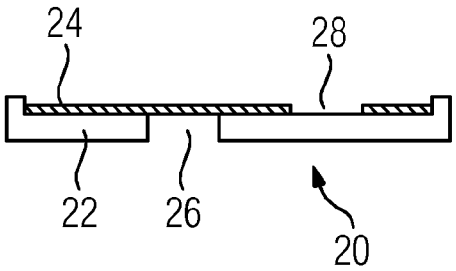
FIGS. 3 and 4 are sectional side view diagrams of the valve.
Figure 4:
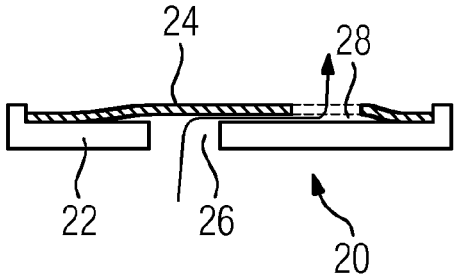

A typical embodiment of a valve 20 is shown in FIGS. 2, 3 and 4. FIG. 2 represents the view from above onto a valve 20 with a valve body 22 and a valve membrane 24. The valve body 22 comprises at least one valve body opening 26 and the valve membrane 24 includes at least one valve membrane opening 28. This construction is similarly shown in a sectional view from the side in FIG. 3. FIG. 3 presents the valve 20 in a closed state, in which it does not let through any medium such as air for example. It should be pointed out that the permeability here is suppressed as well as possible. This means that, as a result of manufacturing tolerances, etc., there is necessarily a small amount of permeability and that this must be taken into account. In other words FIG. 3 represents a closed valve, which essentially does not let any medium through. FIG. 4 shows the valve 20 in the same view, but in an opened state, so that e.g. air can flow through. The valve 20 is preferably opened by means of an overpressure which is pre-sent from the side of the valve body opening 26 at the valve membrane 24. This pressure presses the valve membrane 24 such that air can escape through the valve membrane opening 28.

The normal state of the valve 20 is as shown in FIGS. 2 and 3. Normal state is understood as the ambient pressure being pre-sent at a valve and said valve being closed in this case. Air under pressure can only flow from one direction through the valve 20, namely when this initially flows through the valve body opening 26, and presses on the valve membrane 24 such that it can escape through the valve membrane opening 28 again. This process is shown in FIG. 4. The reverse direction is not possible here, since air pressure from the other direction would merely press the valve membrane 24 against the valve body opening 26, so that this remains airtight and does not let any air through.

Figure 5:
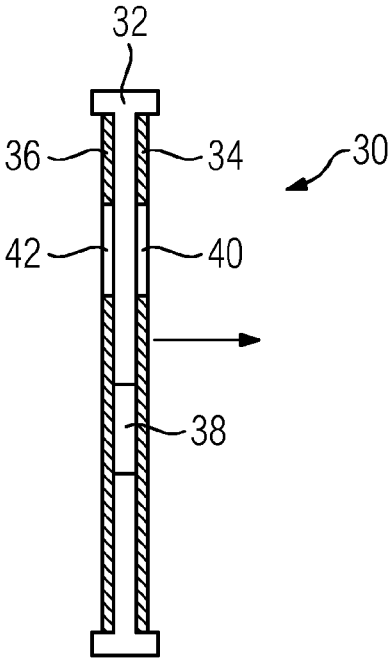
FIG. 5 is a side view diagram of an alternative valve.

An alternative embodiment of a valve 30 is shown in a sectional side view in FIG. 5. Arranged on a valve body 32 from two opposing sides are a first valve membrane 34 and a second valve membrane 36. An overhead view of one of the valve membranes is similar to the overhead view as shown in FIG. 2. At least one valve body opening 38 is located on the valve body 32. The two valve membranes each have at least one first valve membrane opening 40 and a second valve membrane opening 42. In the state shown the valve 30 is blocked for both possible passage directions. One of the valve membranes, e.g. first valve membrane 34, must first be opened or lifted so that air can flow through the first valve membrane opening 40 and the valve body opening 38. Provided the pressure to which the air is subjected is sufficient, this can then press open the second valve membrane 36 from the sides of the valve body opening 38, so that the air can flow out through the second valve membrane opening 42. This process functions in a similar manner in the other direction. Different options for opening or lifting one of the valve membranes are described in the following embodiments.

All embodiments described below use valves as have just been explained. This however does not represent any exclusive use of these valves. Other valve types not described in any greater detail are also possible. Furthermore the examples which now follow only refer to two valve assemblies, which in their turn each comprise a different number of individual valves. To improve clarity the valves and valve assemblies of the following embodiments are not always labeled with reference characters. Only where it is necessary for the understanding of the method of operation is a reference character used.

In addition a number of types of pump process are described below. These must if necessary be repeated multiple times in order to achieve a desired effect. The term movement of a pump membrane preferably means the oscillation of the pump membrane.

Figure 6:
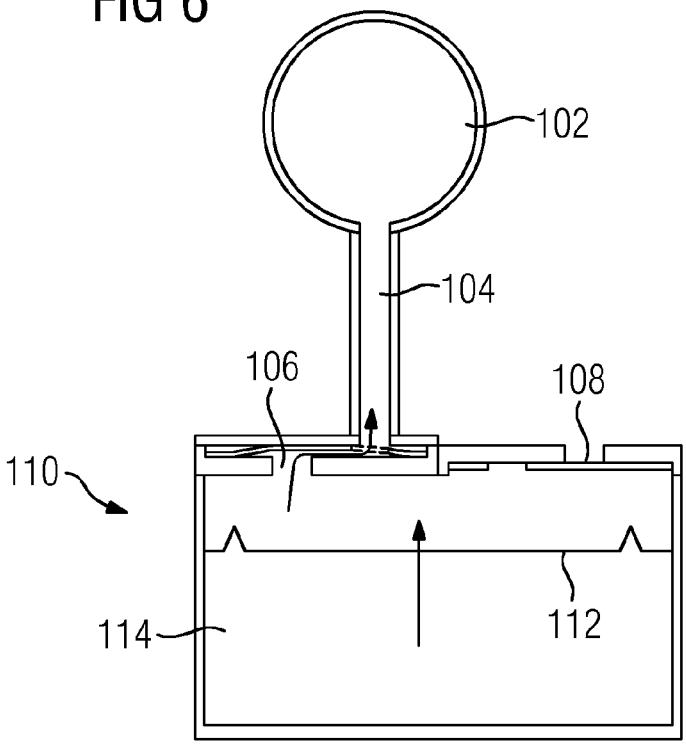
FIGS. 6 and 7 are side view diagrams of an embodiment of a pump facility.
Figure 7:
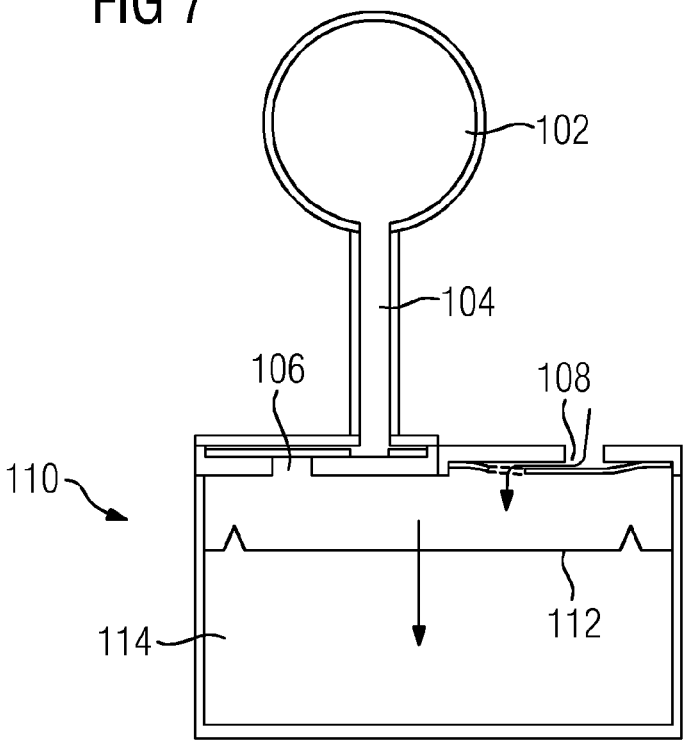

FIGS. 6 and 7 show a schematic of a pump facility 110 and the pumping-up of a variable-volume element 102. This element is connected in this embodiment by means of a channel facility 104 to a first valve assembly 106. A pump facility 110 with a pump membrane 112 can suck in air through a second valve assembly 108 in a sucking-in process from outside the circuit shown in FIGS. 6 and 7. The pump facility 110 in this version implements the function of a filling mechanism and a drainage mechanism.

In the sucking-in process the pump membrane 112 as in FIG. 7 is moved away from the second valve assembly 108. In this way a vacuum is generated in the pump chamber 114, which lifts the valve off the valve assembly 108 towards the pump membrane 112 and thus opens said valve. Air then flows through the valve assembly 108 to the pump chamber 114.

In a pumping process, as is shown in FIG. 6, the pump membrane moves in the direction of the two valve assemblies 106 and 108. The second valve assembly 108 remains closed in this case, in this way no air or no air pressure can escape to outside this described circuit. However the first valve assembly opens, air thus reaches the channel facility 104 and from there reaches the variable-volume element 102. This is inflated by the pumped-in air pressure.

Figure 8:
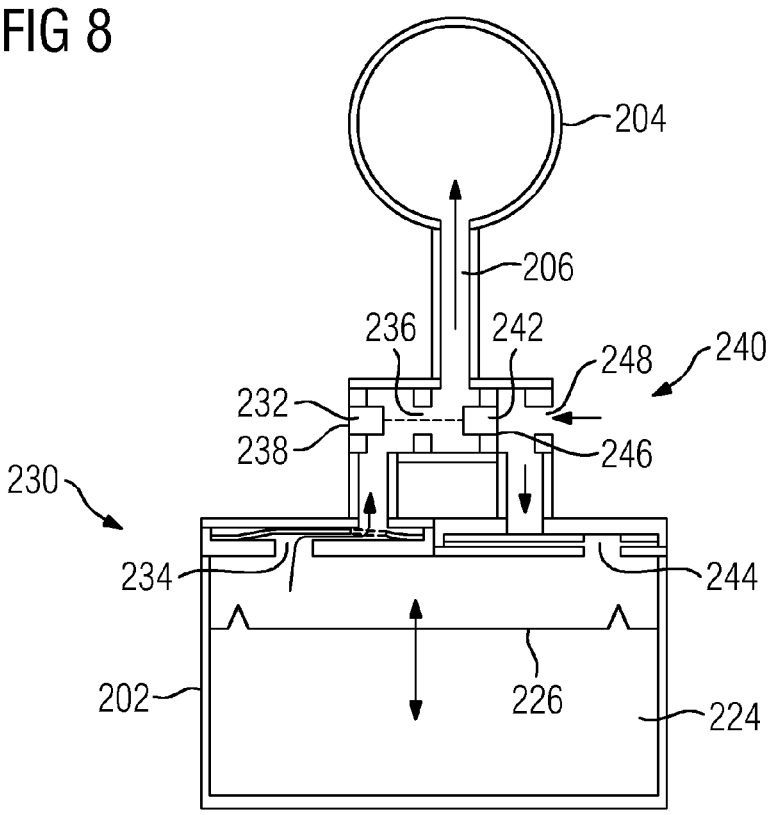
FIGS. 8 and 9 are side view diagrams of a further embodiment of a pump facility.
Figure 9:
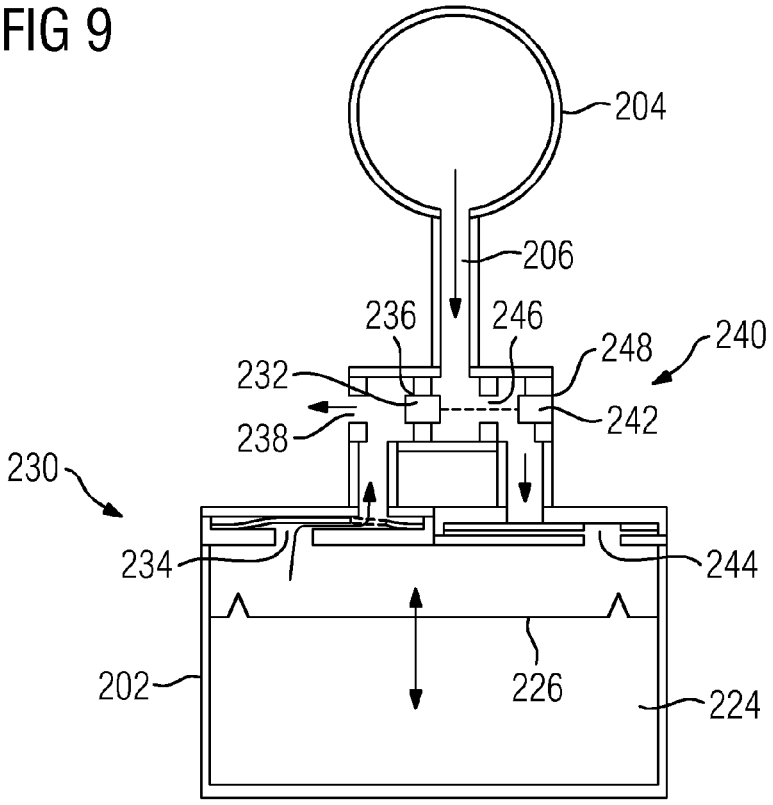

A further embodiment of a pump facility 202 is sketched out in FIGS. 8 and 9. The pump facility 202 in this version implements the function of a filling mechanism and a drainage mechanism. A variable-volume element 204 is shown in each case which is in contact through a channel facility 206 with a first valve assembly 230 and a second valve assembly 240. The valve assemblies 230 and 240 in their turn are in contact with the pump facility 202, so that this device can pump air through the channel facility 206 into and out of the variable-volume element 204. Furthermore the pump chamber 224 and the movable pump membrane to 226 are arranged on the pump facility 202.

The first valve assembly 230 comprises a first sliding valve 232, a first membrane valve 234, a first channel opening 236 and an outlet opening 238. The second valve assembly 240 comprises a second sliding valve 242, a second membrane valve 244, a second channel opening 246 and an inlet opening 248.

The two sliding valves 232 and 242 shown here differ from the valves described in detail above. These valves involve valves which depend on one another. The sliding valves 232 and 242 can either block the outlet opening 238 and the second channel opening 246 or the inlet opening 248 and the first channel opening 236. These two variants are shown in FIGS. 8 and 9. Blocking here is to be understood as the closing of a valve in a specific passage direction. In addition intermediate areas are produced in which none of the openings are blocked and air so to speak can flow through the valve in all directions. The sliding valves 232 and 242 are connected or in contact such that a movement or displacement of a sliding valve results in the corresponding movement of the other. Such a movement can be effected manually or automatically by means of a motor.

The pumping-up of the variable-volume element 204 proceeds as described below. In a sucking-in movement the pump membrane 226 moves away from the valve assemblies 230 and 240. In this case the sliding valves 232 and 242 are in a position in which they each close off the outlet opening 238 and the second channel opening 246. Air is thus sucked in through the inlet opening 248, which reaches the pump chamber 224 through the second membrane valve at the second valve assembly 240. The first membrane valve 234 remains closed off during this process.

In a pumping movement the pump membrane 226 moves towards the valve assemblies 230 and 240. In this case the sliding valves 232 and 242 are still in a position in which they close off the outlet opening 238 and the second channel opening. Because of the pumping movement the second membrane valve 244 remains closed. The first membrane valve 234 opens through the pump pressure. Pressurized air can thus be pumped from the pump chamber 224 through the first valve assembly 230 and the channel facility 206 into the variable-volume element 204. This is pumped up by the additional air pressure or its volume is enlarged.

Conversely, when the air is pumped out of the variable-volume element 204, the sliding valves 232 and 242 are in a different position. These valves now close off the first channel opening 236 and the inlet opening 248. In a sucking-in movement of the pump membrane 226 the pump facility 202 draws in the air from the variable-volume element 204 through the channel facility 206 and the second valve assembly 240 in the direction of the pump chamber 224. The second membrane valve 244 opens as a result of the suction pressure and al-lows the passage of the air. The variable-volume element 203 shrinks or reduces in size. The surplus air in the pump chamber is now pumped out of the pump chamber 224 by means of a further pumping movement of the pump membrane 226 in the direction of the two valve assemblies 230 and 240. For this to occur the air moves past the first membrane valve 234 and the first valve assembly to the open outlet opening 238.

Figure 10:
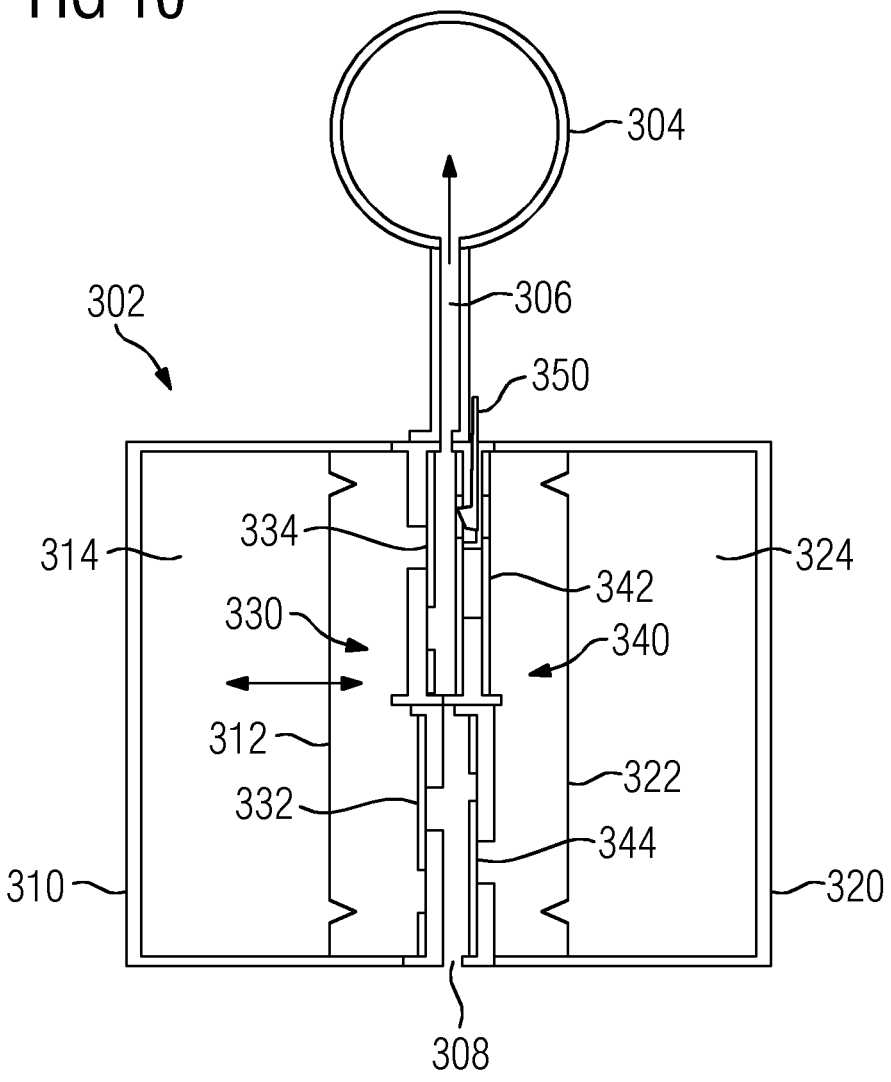
FIGS. 10 and 11 show diagrams of a further embodiment of a pump facility with a manual initiation mechanism.
Figure 11:
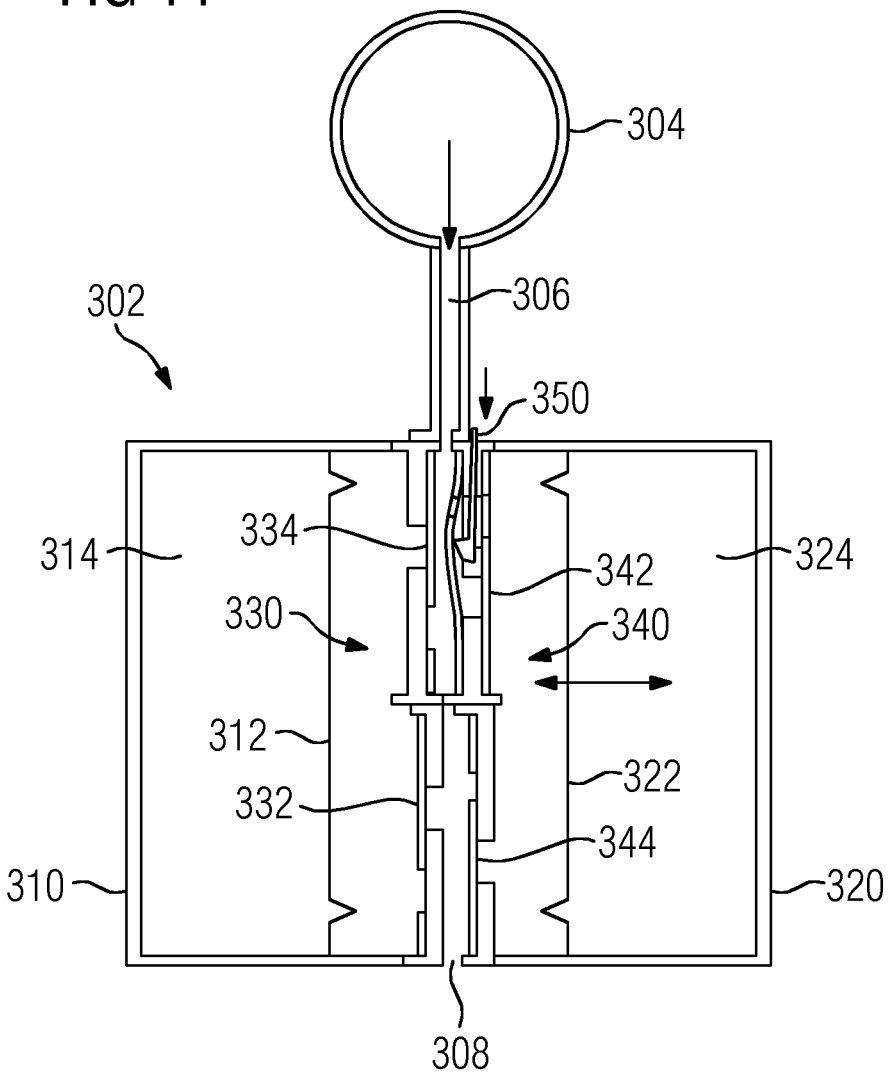

FIGS. 10 and 11 show a further embodiment of the pump facility 302. Also shown are a variable-volume element 304, a channel facility 306 and an opening 308. In addition a filling mechanism 310 with a first pump membrane 312 and a first pump chamber 314 and also a drainage mechanism 320 with a second pump membrane 322 and a second pump chamber 324 are arranged on the pump facility 320. In this case the filling mechanism 310 and the drainage mechanism 320 each involve a pump. In addition a first valve assembly 330 with a first suction valve 332 and a first pressure valve 334, and also a second valve assembly 340 with a second suction valve 342 and a second pressure valve 344 are depicted.

The pumping-up process of the variable-volume element 304 is undertaken in a similar manner to the previous exemplary embodiments by means of the filling mechanism 310 and the further components needed for this process.

A particular feature of this embodiment is the mechanical actuator 350, which is arranged displaceably on the second suction valve 342. This assists or makes possible the emptying of the variable-volume element 304.

The second suction valve 342 is designed so that in the normal state it keeps both passage directions closed off. The actuator 350 can initially open a part of the second suction valve 342. To do this it must be displaced so that, as a result of the shape it lifts one of the membranes of the second suction valve 342 such that said membrane opens. Air flows into the second suction valve 342. The opening of the other membrane of the second suction valve 342 must however be initiated through a suction movement of the second pump membrane 322 or the presence of air pressure, so that the second suction valve 342 opens such that air can be sucked from the variable-volume element 304 into the second pump chamber 324.

The actuator 350 is moved automatically by a motor for example from outside the apparatus or the hearing device by the user himself or herself.

Figure 12:
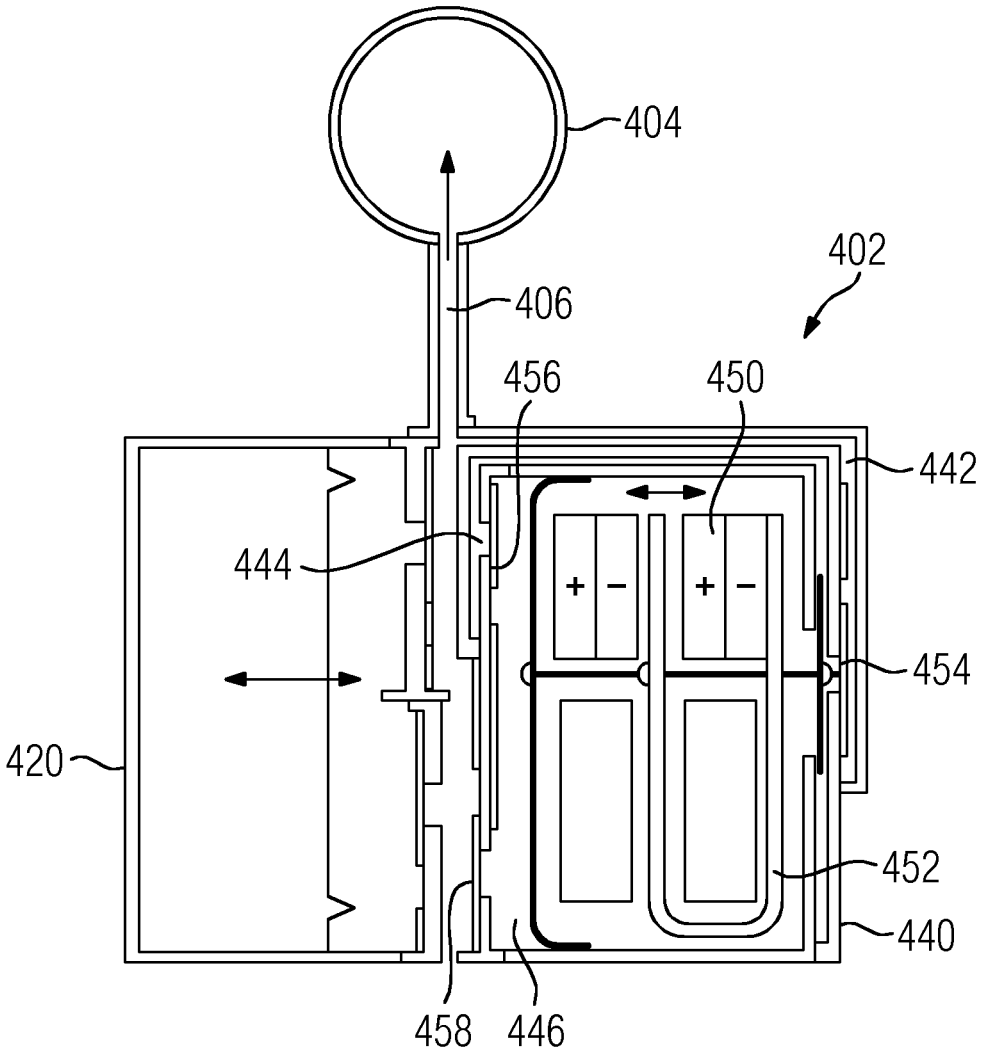
FIG. 12 shows a diagram of a further embodiment of a pump facility with a magnetic pump mechanism.

A further embodiment is shown schematically in FIG. 12. The pump facility 402 includes inter alia a filling mechanism 420 and a drainage mechanism 440. These involve a pump in each case. The pump facility is in contact with the variable-volume element 404 by means of the channel facility 406.

The filling mechanism 420 implements the function of pumping-up the variable-volume element 404. The way in which this pumping-up process functions is identical to the previous exemplary embodiment. For this reason a more detailed explanation of this process will not be given here.

The drainage mechanism 440 is constructed from a number of components. A first side channel facility 442 and a second side channel facility 444 make a flow of air into a pump chamber 446 possible. A magnetic facility 450 controls the movement of a magnetically-movable membrane facility 452. This is in direct contact with first inlet valve 454 so that it can be controlled by the membrane facility 450 too as a result of said device's movement. In addition a second inlet valve 456 and an outlet valve 458, which open by means of the presence of pressure, are arranged on the drainage mechanism 440.

To empty the variable-volume element 404 the magnetic facility 450 is polarized magnetically such that this device moves the magnetically-movable membrane facility 452 in the direction of the first inlet valve 454. Through the connection of the membrane facility 452 to the first inlet valve 454 it is accordingly opened in this process. Air flows out of the variable-volume element 404, initially through the channel facility 406, the first side channel facility 442 and the first inlet valve 454, into the second side channel facility 444. The membrane facility 452, as a further function of its movement, performs a pumping movement. In this case a suction movement, as a result of which the air flows from the second side channel facility 444 through the second inlet valve 456 into the pump chamber 446.

In the next step the polarity of the magnetic facility is changed such that the membrane facility moves so that, in its turn, this displaces the first inlet valve 454. As a further function of this movement the membrane facility 452 pumps the air out of the pump chamber 456 through the drain valve 458. The air subsequently escapes from the pump facility 402.

Figure 13:
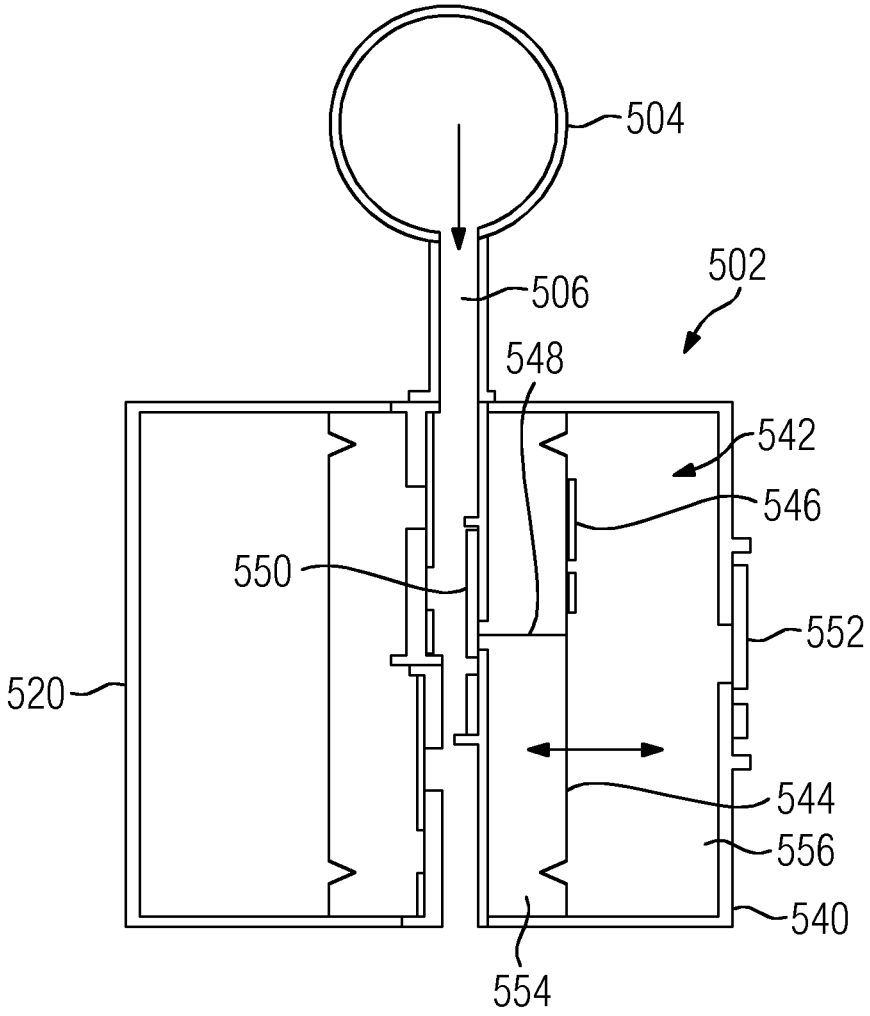
FIG. 13 shows a diagram of a further embodiment of a pump facility with a valve facility which is integrated on a pump membrane.

FIG. 13 shows a further embodiment of a pump facility 502. A variable-volume element 504 is connected through the channel facility 506 to the pump facility 502. A filling mechanism 520 with its respective components fills the variable-volume element 504, as already described in the preceding embodiments.

A drainage mechanism 540 has a pump chamber 542 and a membrane facility 544. The pump chamber 542 is divided into a front pump chamber area 554 and a rear pump chamber area 556. Arranged on the membrane facility 544 are a pump membrane valve device 546 and a connecting element 548. The pump membrane valve device 546 in this version is a valve which is integrated into a pump membrane and which opens if a prespecified pressure is present. The connecting element 548 connects the membrane facility 544 with an inlet valve 550, so that a movement or oscillation of the membrane facility 544 can open or close the inlet valve. In addition an outlet valve 552 is arranged on the drainage mechanism 540, which opens if pressure is present.

To empty out air or to discharge the pressure of a pressurized variable-volume element 504, the membrane facility 544 in the drainage mechanism 540 initially moves in the direction of the inlet valve 550. As a result of the arrangement of the connecting element 548 with the moving membrane facility 544 the inlet valve 550 opens in this case. Air flows from the variable-volume element 504 through the inlet valve 550 into the front pump chamber area 554. As a result of the movement of the membrane facility 544 just described the air is compressed in the front pump chamber area 554, so that the pressure resulting therefrom is present at the pump membrane valve facility 546 and opens this device. The air thus reach-es the rear pump chamber area 556.

Subsequently the membrane facility 544 moves in the other direction. The inlet valve 550 and the pump membrane valve facility 546 close again. The air in the rear pump chamber area 556 is pushed by the membrane facility 544 onto the outlet valve 552 which opens because of this pressure. The air then escapes from the pump facility 502.

Figure 14:
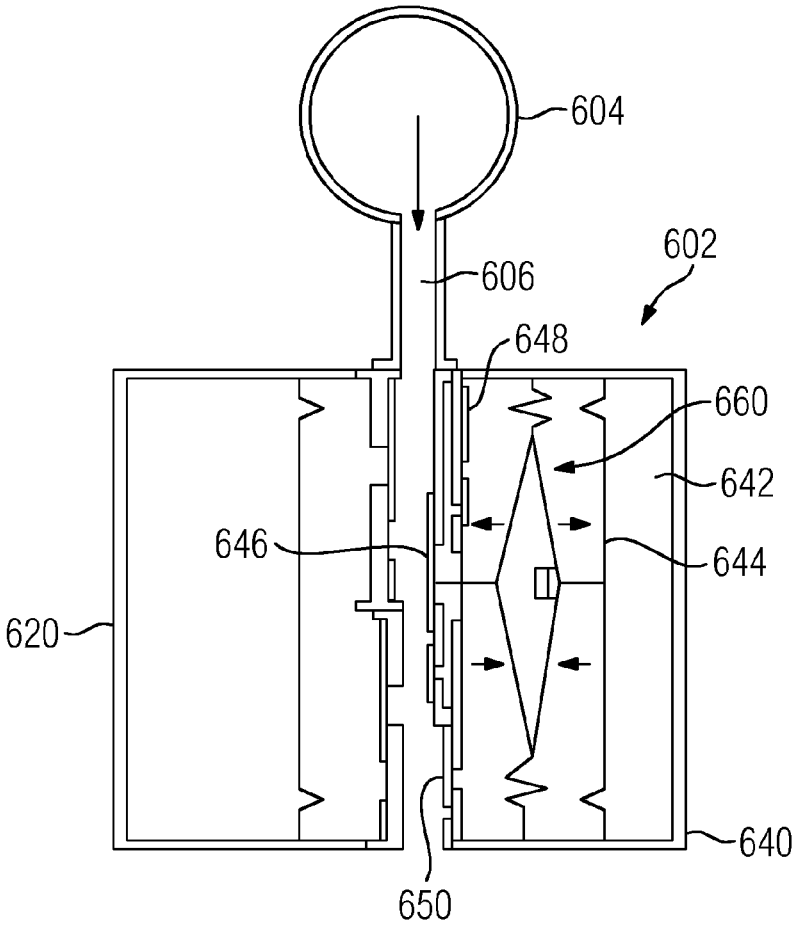
FIG. 14 shows a diagram of a further embodiment of a pump facility with a trapezoid drive facility.

A further embodiment of a pump facility 602 is sketched out in FIG. 14. A filling mechanism 620 with its respective components fills the variable-volume element 604 as already de-scribed in the preceding embodiments.

The emptying of the variable-volume element 604 by means of a trapeze drive facility 660 is described specifically in this embodiment. This is integrated in the drainage mechanism 640. Also arranged in the drainage mechanism 640 are a pump chamber 642 and a pump membrane 644 in contact with the trapeze drive facility 660. In addition the trapeze drive facility 660 is in contact with a first inlet valve 646 such that it can be opened and closed by means of the trapeze drive facility 660. A second inlet valve 648 and an outlet valve 650 on the drainage mechanism 640 react or open respectively when pressure is present.

One of the functions of the trapeze drive facility 660 is to control the first inlet valve 646. In addition it must simultaneously move the pump membrane 644 in order to carry out pumping processes. Two opposing corners of the total four corners of the trapeze drive facility 660 respectively are in contact with the first inlet valve 646 and the pump membrane 644, as already described above. These two corners drift apart when the other two corners are pressed together. Thus the first inlet valve 646 is opened and simultaneously a suction pumping movement of the pump membrane 644 is carried out. In this way air from the variable-volume element 604 and the channel facility 606 gets through the first inlet valve 646. The air then lies against the second inlet valve 648. Through the pressure which is applied to the air and the suction movement of the pump membrane 644 the second inlet valve also opens 648 and the air reaches the pump chamber 642.

Next the trapeze drive facility 606 is pulled apart such that said drive device closes off the first inlet valve 646 again and the pump membrane 644 carries out a pumping movement which pushes the air against the drain valve 650. Through this pressure the outlet valve opens and the air escapes from the drainage mechanism 640 or from the pump facility 602.

Figure 15:
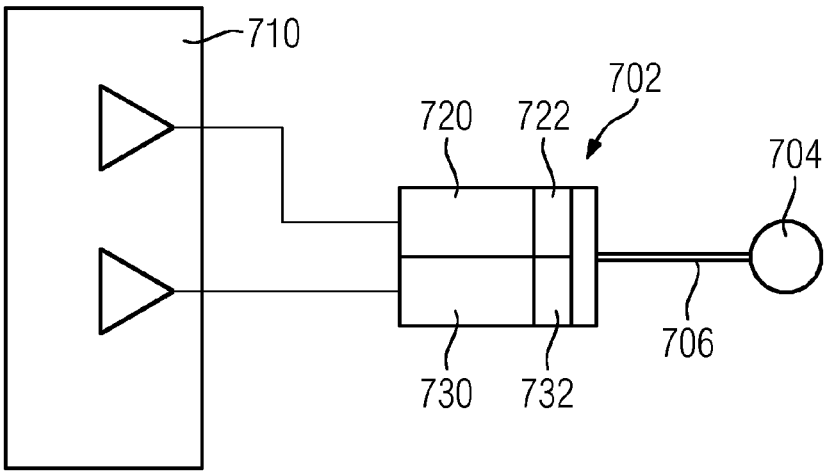
FIG. 15 shows a schematic diagram for controlling a pump facility.

A possible embodiment for controlling a pump facility 702 is shown schematically in FIG. 15. A control facility 710 is usually integrated into a hearing device not shown in the figure. This can for example involve an integrated circuit. The control unit 710 in this example controls a first motor 720 and a second motor 730. The motors 720 and 730 in their turn control and/or activate a first pump and valve assembly 722 and a second pump and valve assembly 732 in each case. The first pump and valve assembly 722 pumps air through the channel facility 706 into the variable-volume elements 704. In the reverse direction the second pump and valve assembly 732 pumps this air if necessary out of the variable-volume elements 704 again. The said processes are explicitly controlled and initiated by the control unit 710.

The invention claimed is:

1. A pump facility for an earmold of a hearing device, which comprises:

a channel facility fluidically connectable with a variable-volume element of the earmold, enabling a medium to flow through said channel facility to and from the variable-volume element when the variable-volume element is fluidically connected to said channel facility;

a filling mechanism configured for pumping and conveying the medium to the variable-volume element through said channel facility;

a drainage mechanism embodied for pumping and conveying the medium away from the variable-volume element through said channel facility;

a first valve assembly configured to control or enable an inflow of the medium from said filling mechanism to the variable-volume element; and a second valve assembly configured to control or enable an out-flow of the medium from the variable-volume element to an outlet, wherein each of said first valve assembly and said second valve assembly is controlled and/or enabled separately from one another.

2. A pump facility for an earmold of a hearing device, which comprises:

a channel facility fluidically connectable with a variable-volume element of the earmold, enabling a medium to flow through said channel facility to and from the variable-volume element when the variable-volume element is fluidically connected to said channel facility;

a filling mechanism configured for pumping and conveying the medium to the variable-volume element through said channel facility;

a drainage mechanism embodied for pumping and conveying the medium away from the variable-volume element through said channel facility;

a first valve assembly configured to control or enable an inflow of the medium from said filling mechanism to the variable-volume element and a second valve assembly configured to control or enable an out-flow of the medium from the variable-volume element to an outlet, wherein one or both of said filling mechanism or said drainage mechanism have a pump membrane in contact, by way of a connecting element, with one of said first or second valve assemblies.

3. The pump facility according to claim 2, wherein a valve is integrated into said pump membrane.

4. A pump facility for an earmold of a hearing device, which comprises:

a channel facility fluidically connectable with a variable-volume element of the earmold, enabling a medium to flow through said channel facility to and from the variable-volume element when the variable-volume element is fluidically connected to said channel facility;

a filling mechanism configured for pumping and conveying the medium to the variable-volume element through said channel facility;

a drainage mechanism embodied for pumping and conveying the medium away from the variable-volume element through said channel facility;

a first valve assembly configured to control or enable an inflow of the medium from said filling mechanism to the variable-volume element; and a second valve assembly configured to control or enable an out-flow of the medium from the variable-volume element to an outlet, wherein at least one of said first or second valve assemblies is a passively controlled or enabled assembly.

5. A pump facility for an earmold of a hearing device, which comprises:

a channel facility fluidically connectable with a variable-volume element of the earmold, enabling a medium to flow through said channel facility to and from the variable-volume element when the variable-volume element is fluidically connected to said channel facility;

a filling mechanism configured for pumping and conveying the medium to the variable-volume element through said channel facility;

a drainage mechanism embodied for pumping and conveying the medium away from the variable-volume element through said channel facility;

a first valve assembly configured to control or enable an inflow of the medium from said filling mechanism to the variable-volume element and a second valve assembly configured to control or enable an out-flow of the medium from the variable-volume element to an outlet, wherein at least one of said first or second valve assemblies is a magnetically controlled assembly.

6. A pump facility for an earmold of a hearing device, which comprises:

a channel facility fluidically connectable with a variable-volume element of the earmold, enabling a medium to flow through said channel facility to and from the variable-volume element when the variable-volume element is fluidically connected to said channel facility;

a filling mechanism configured for pumping and conveying the medium to the variable-volume element through said channel facility;

a drainage mechanism embodied for pumping and conveying the medium away from the variable-volume element through said channel facility;

a first valve assembly configured to control or enable an inflow of the medium from said filling mechanism to the variable-volume element;

a second valve assembly configured to control or enable an out-flow of the medium from the variable-volume element to an outlet; and a trapeze drive configured to control at least one of said first or second valve assemblies.

7. The pump facility according to claim 1, wherein the medium is air.

8. A hearing device, comprising a pump facility according to claim 1 and an earmold with an inflatable balloon member fluidically connected to said pump facility.

9. A hearing device, comprising a pump facility according to claim 2 and an earmold with an inflatable balloon member fluidically connected to said pump facility.

* * * * *